United States Patent [19]

Spang et al.

[11] Patent Number: 4,829,283

[45] Date of Patent: May 9, 1989

[54] SUPERVISION ARRANGEMENT FOR SMOKE DETECTORS

[75] Inventors: Kim J. Spang, Aurora; Daniel Minarik, Buffalo Grove; William H. MacPherson, West Chicago, all of Ill.

[73] Assignee: Pittway Corporation, Northbrook, Ill.

[21] Appl. No.: 141,054

[22] Filed: Jan. 5, 1988

[51] Int. Cl.[4] ..... G08B 29/00; G08B 23/00

[52] U.S. Cl. ..... 340/506; 340/628; 340/693

[58] Field of Search ..... 340/506, 500, 531, 628, 340/649, 650, 653, 687, 693

[56] References Cited

U.S. PATENT DOCUMENTS

| | | | |
|---|---|---|---|
| 4,092,641 | 5/1978 | Bellinghausen et al. | 340/628 |
| 4,315,594 | 2/1982 | Niederost | 340/693 |
| 4,369,435 | 1/1983 | Adachi et al. | 340/506 |
| 4,724,430 | 2/1988 | Igarashi | 340/630 |

*Primary Examiner*—Donnie L. Crosland

*Attorney, Agent, or Firm*—Dressler, Goldsmith, Shore, Sutker & Milnamow

[57] ABSTRACT

A plug-in sensing unit includes a detector base and a detector head constructed and arranged for mounting on the detector base, with contacts of the detector head engaging terminals of the detector base when the detector head is mounted on the detector base for extending power to a sensor housed within the detector head. A cam on the detector head moves a shorting spring to interconnect a pair of terminals on the detector base to complete a circuit path indicative of the presence of a detector head in the detector base, a further cam on the detector head cooperates with a cam on the detector base to enable the contact spring to restore to its rest position when the detector head is removed from the detector base. The shorting spring can be moved to its operating position manually during testing of the loop in which the detector base is connected, the contact spring being restored to its rest position automatically during the initial stage of mounting of a detector head on the detector base.

22 Claims, 3 Drawing Sheets

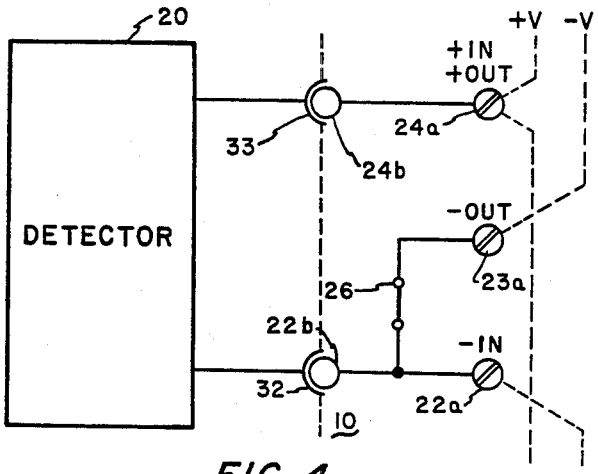
FIG. 4
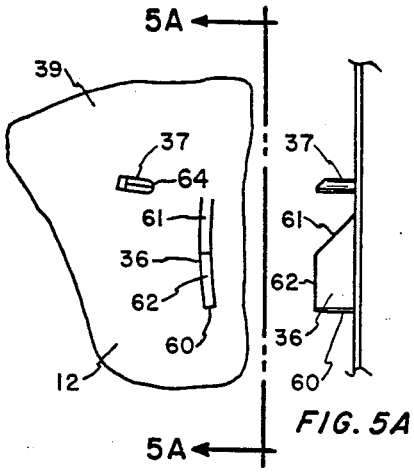
FIG. 5A
FIG. 5
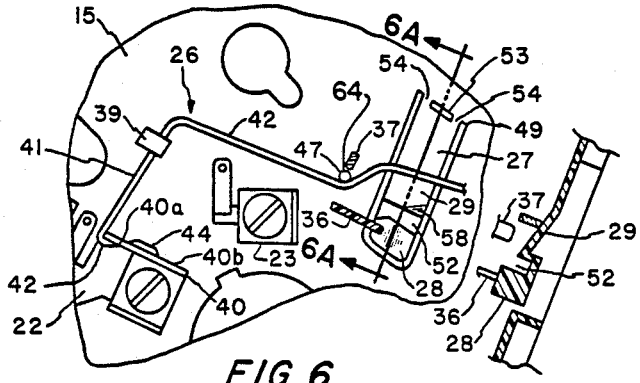
FIG. 6
FIG. 6A
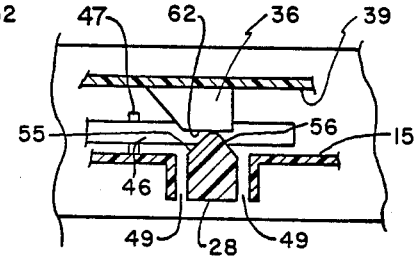
FIG. 7A
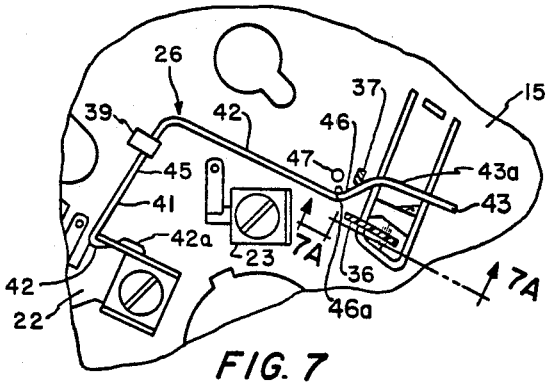
FIG. 7
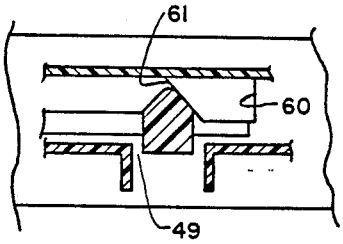
FIG. 8A
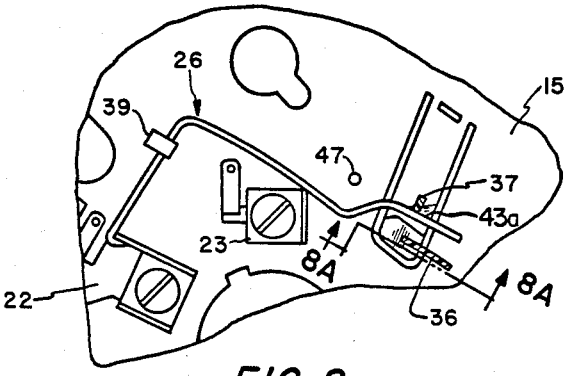
FIG. 8

SUPERVISION ARRANGEMENT FOR SMOKE DETECTORS

BACKGROUND OF THE INVENTION

This invention relates to plug-in sensor units for monitoring systems and more particularly, to a supervisory arrangement for such sensor units.

In monitoring systems for large building complexes, it is common practice to provide an alarm control panel at a central location for supervision of each of a plurality of sensor units located throughout the building complex and connected to the alarm control panel by two or more conductors, typically a pair of conductors for extending electrical power to the sensor units and one or more additional conductors for supervisory purposes.

Various sensor mounting arrangements are available for such sensor units. Direct-wire sensor units are designed for mounting directly on a mounting surface with hard-wired connections between the sensor unit and the alarm control panel. In a common arrangement plug-in sensor units are used. This can include a two-piece assembly including a detector base which is hard-wired into the monitoring system and a plug-in detector head which is constructed and arranged for snapping into the detector base. The use of plug-in sensor units not only facilitates installation and maintenance, but also permits sensor units to be interchanged as necessary affording numerous advantages and increasing the flexibility of the system. The detector bases may be installed in new construction without exposing the detector sensing heads to plaster, dust and other contamination in buildings nearing completion. Plug-in units are particularly suitable for use in installations that have many detector heads, and high ceiling installations and environments where detectors may require frequent maintenance or cleaning. The sensor units can be serviced, tested and cleaned more easily than hard-wired surface-mounted units, especially when mounted on high ceilings, because the detector head can be removed without a ladder using suitable tools. Also, if a plug-in detector head is faulty or unsuitable for a given location, it can simply be unplugged and readily replaced by a compatible unit.

A shortcoming of the plug-in sensor unit is its susceptibility to tampering. Although anti-tampering arrangements are sometimes employed, if a person attempting to defeat the system should be successful in removing a detector head, the absence of the detector head may not be noticed for a long period of time. Also, removal of the detector head may affect the operation of the monitoring system.

Accordingly, arrangements have been proposed for the supervision of detector head installations. In one known arrangement, a shorting contact is provided on each detector base. The shorting contact is manually operable to interconnect a pair of terminals of the detector base, thereby connecting the detector base in series with the power conductors and with other sensor units in the system. This shorting contact is operated to open this circuit path which is then completed by a conductive shorting loop on the detector head, by a mechanical cam on the detector head when the detector head is plugged into the detector base. However, the detector head does not operate the shorting contact to its connection position when a detector head is mounted on or removed from the base. Thus, if the detector head is subsequently removed, the shorting contact is not operated, interrupts the power circuit for the sensors of the system, and the voltage to detectors further down the zone is interrupted. This condition is indicated on the alarm control panel.

The shorting contact may be closed manually during system installation or service when the detector head is not in place. Electrical supervision of detector installation at that location is then disabled.

In this prior art arrangement, mounting of the detector head on the detector base causes disruption of the shorting loop by operating the spring contact out of engagement with a terminal on the detector base. The shorting contact is spring loaded and the cam on the bottom of the detector head releases the spring contact to its open position when the detector head is installed on the detector base. Also, because the electrical circuit path is completed through a further shorting loop on the detector head, a separate connection is required between the detector head and the detector base to provide this supervisory arrangement. Because the electrical connection is provided within the detector head, this both complicates the wiring connection arrangement and requires a separate plug/connector for plug-in sensor units of this type.

SUMMARY OF THE INVENTION

In accordance with the invention, a plug-in sensor unit, including a detector base and a detector head, is provided. The unit is arranged for removable mounting on the detector base and to be locked to the detector base with movement of the detector head relative to the detector base to a locking position, the detector head housing a detector having contacts engaging terminals on the detector base when the detector head is assembled together with the detector base and moved to its locking position, the sensor including contact means mounted on the detector base adjacent to first and second ones of the terminals, the contact means having a mounting portion connected to the first terminal and a contact portion movable between a first position where it engages the second terminal and a second position where it is disengaged from the second terminal, the contact means interconnecting the first and second terminals when its contact portion is at its first position, and actuating means on the detector head engaging the contact means during mounting of the detector head on the detector base to move the contact portion of the contact means from its second position to its first position, retaining means on the detector base to retain the contact portion of the contact means at its first position, and release means on the detector base, and operated by the actuating means for controlling said retaining means during removal of the detector head from the detector base to release the contact portion of the contact means, allowing it to return to its second position.

The invention consists of certain novel features and structural details hereinafter fully described, illustrated in the accompanying drawings, and particularly pointed in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

FIG. 4 is an illustration of a typical wiring diagram for the sensor unit;

FIG. 5 is an enlarged fragmentary view illustrating the operating cams of the detector head for the sensor unit shown in FIG. 1;

FIG. 5A is an elevational view taken along the line 5A—5A of FIG. 5;

FIG. 6 is an enlarged fragmentary view of the detector base illustrating the shorting spring in its rest position, FIG. 6A is a side elevational view taken along the lines 6A—6A of FIG. 6;

FIG. 7 is an enlarged fragmentary view of the detector base illustrating the shorting spring partially operated by the cam mechanism of the detector head;

FIG. 7A is an end view taken along the lines 7A—7A of FIG. 7;

FIG. 8 is a plan view similar to FIG. 7 illustrating the shorting spring operated to its shorting position where it interconnects a pair of terminals of the detector base;

FIG. 8A is an end view similar to FIG. 7A taken along the lines 8A—8A of FIG. 8;

DESCRIPTION OF A PREFERRED EMBODIMENT

Figure 1:
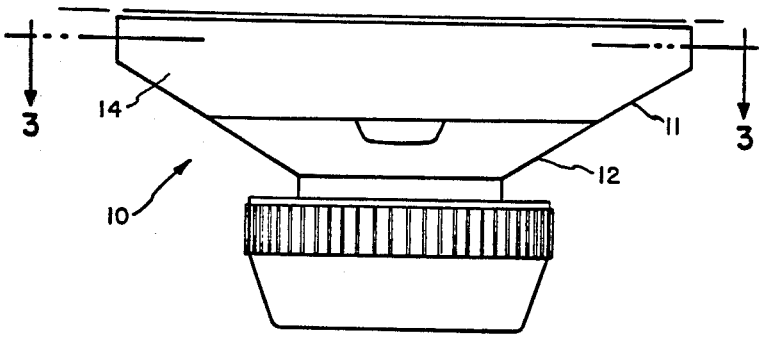
FIG. 1 is a side elevation view of a plug-in sensor unit incorporating the supervisory arrangement provided by the present invention.

Referring to FIG. 1, there is shown a plug-in sensor unit 10, such as a smoke detector, incorporating the supervisory arrangement provided in accordance with the principles of the present invention. The sensing unit 10 includes a detector base 11 and a detector head 12, which houses the detector 20 (FIG. 4) and is constructed and arranged to be removably mounted on the detector base 11. The detector head and detector base include suitable complementary slots and projections of the type known in the art which enable the detector head to be plugged into the detector base and then locked thereto as by relative rotation of the detector base and detector head in one direction to lock the elements together and in the opposite direction to release them. The detector base may be installed on a ceiling or a wall of a building or building complex, a plurality of such units forming an installation in all of the units be hardwired to an alarm control panel (not shown) located in a central location within the building or building complex.

Figure 2:
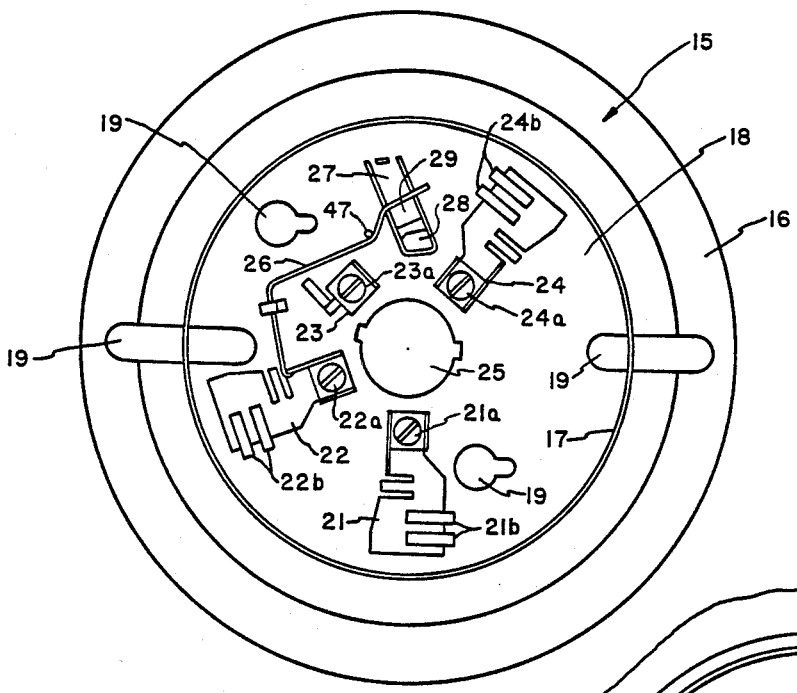
FIG. 2 is a bottom plan view for the detector base of the sensor unit shown in FIG. 1.

Referring to FIG. 2, the detector base 11 includes a base plate 15 having a peripheral flange 16 and an annular wall 17 defining a recessed surface 18 for the detector base 11. The surface 18 includes a plurality of mounting holes 19 which facilitate attachment of the detector base 11 to a ceiling or wall surface by screws or other fasteners. A decorative ring 14 (FIG. 1) is mounted over the peripheral flange portion 16 of the detector base 11 after it has been installed.

Referring again to FIG. 2, the detector base 11 includes four base terminals 21–24 mounted on the surface 18, each including respective screw terminals 21*a*–24*a* to which are connected electrical conductors (not shown) which extend through an aperture 25 in the base 13 and connect the detector base 11 to an alarm control panel (not shown).

The base terminals 21, 22 and 24 include respective spring contacts 21*b*, 22*b* and 24*b* which facilitate electrical connection between the base terminals and terminals of the detector 20 (FIG. 4) when the detector head 12 is mounted on the detector base 11 as illustrated in FIG. 1.

The detector base 11 further includes a shorting spring 26 which is an operative element of the supervisory arrangement of the present invention. The shorting spring 26 permits testing of the loop wiring before the detector head 12 (FIG. 1) is installed, and also provides an indication of the absence of the detector head 12 in the detector base 11. The detector base 11 includes an actuator mechanism including a cantilever mounted member 27 bearing cams 28 and 29, which permit the shorting spring 26 to be reset automatically to its at rest position when the detector head 12 is plugged into the detector base 11.

Figure 3:
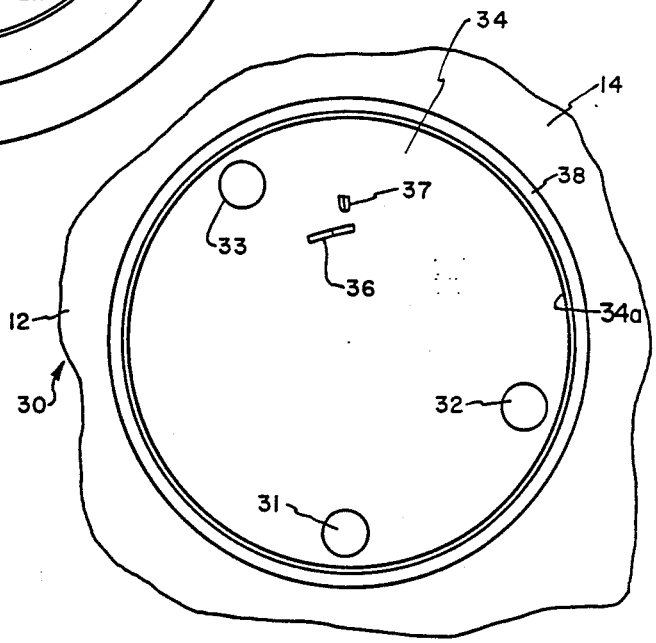
FIG. 3 is a vertical section taken along the line 3—3 of FIG. 1.

Referring to FIG. 3, the detector head 12 includes a base 30 to which are secured three contacts 31, 32 and 33 on the upper surface 34 thereof. The contacts 31–33 are connected to terminals of the smoke detector 20 (FIG. 4) housed within the detector head 12, and are engaged by the spring contacts 21*b*, 22*b* and 24*b* (FIG. 2) of the detector base 11 when the two elements are assembled together. The base 30 further has an actuator mechanism in the form of two cams 36 and 37 which project upwardly from the base 30. An annular peripheral wall 38 defines a recessed center portion 34*a* for the base 30. The heights of the two cams 36 and 37 correspond to the height of the wall 38.

The detector head 12 is mountable on the detector base 11 and secured thereto by a suitable latching mechanism, such as projections (not shown) on the detector head which are received in slots (not shown) in the detector base 11, such arrangements being well known in the art of plug-in type smoke detector units. Because this mechanical latching arrangement forms no part of the invention, the latching arrangement is not illustrated herein.

Referring to FIG. 4, which is a simplified wiring diagram for the sensor unit 10, electrical power is supplied to the sensor unit by a two-wire circuit including a positive voltage conductor +V and a negative voltage conductor −V.

In the exemplary embodiment, the sensor unit 10, and each of the other sensor units of the system, has the positive voltage conductor connected to its terminal 24*a* and the negative voltage conductor connected to its contacts 22*a* and 23*a* which has a negative voltage-in conductor segment connected to terminal 22*a* and a negative voltage-out segment connected to terminal 23*a*. The terminals 22*a* and 23*a* are interconnected when the shorting spring 26, represented by a closed switch in FIG. 4, is operated to its operated or shorting position, and the terminals 22*a* and 23*a* are disconnected from one another when the shorting spring is at its rest position.

Spring contact 24*b* is connected to screw terminal 24*a* and spring contact 22*b* is connected to screw terminal 22*a*. Spring contacts 24*b* and 22*b* engage contacts 33 and 32, respectively on the detector head when it is mounted on the detector base, extending power to the detector 30. Referring to FIGS. 2 and 3, the additional contact 31 and terminal 21 are provided for connection to a remote annunciator (not shown) if desired. When the detector head 12 is installed on the detector base 11, the shorting spring 26, represented by a closed switch contact in FIG. 4, interconnects screw terminals 22*a* and 23*a*, completing a circuit path between the negative voltage-in and voltage-out conductor segments. When the detector head 12 is removed from the detector base 11, the shorting spring 26 resets under the force of its resilience, disconnecting the terminals 23*a* and 22*a* and interrupting the circuit path between the conductor segments and thus interrupting the negative voltage conductor for the system. The shorting spring 26 can be operated manually to its shorting position when a detector head 12 is not mounted on the detector base 11. This enables testing of the loop wiring with the detector head removed.

Considering the mechanism for actuating the shorting spring in more detail, referring to FIGS. 6–8, the shorting spring 26, shown in lts "at rest" position in FIG. 6, is cantilever mounted on the base plate 15. The shorting spring, which is of an electrically conducting material, is generally "C" shaped having a mounting portion 41 rigidly affixed to the base plate 15 and a contact portion 42 which extends in cantilever fashion from the mounting portion 41 with its free end 43 located in juxtaposed relation with cantilever portion 27. The mounting portion 41 has an end 44 which hooks around a vertically extending contact portion 40 of the contact 22, with its top 44*a* passing through an aperture 40*a* in the contact portion 40 and extending along the outer surface 40*b* the contact portion. The mounting portion 41 of the shorting spring has a further portion 45 extending generally perpendicular to end 44 and which is entrained by a post 39 extending vertically upward from the base plate 15, the mounting portion 41 of the spring, by virtue of the right angle bend being biased into engagement with the post 39 thereby maintaining its free end 42 secured to the terminal 22 in electrical and mechanical contact and without the need for mechanical hardware such as screws or the like.

The contact portion 42 of the shorting spring 26 is bent, generally at a right angle relative to the mounting portion 41 and extends generally parallel to and spaced from the mounting end 44 and along side of contact 23, the contact portion 42 of the shorting spring being spaced apart from the contact 23 for the at rest position (FIG. 6) and the contact portion engaging the contact 23 for the operated position (FIG. 8) for the shorting spring. The free end 43 of the shorting spring is offset laterally relative to the contact portion 42 and connected thereto by bend 46 which slants outwardly from contact portion 42. A further post 47 extending upward vertically from the base plate 15 defines a stop for the free end of the shorting spring 26, which is pre-loaded or biased into engagement with the post 47.

With reference to FIGS. 6, 6A, and 7A, the base plate 15 has a U-shaped opening 49 formed on the lower surface thereof with the cantilever mounted portion 27 extending therein. Cantilever portion 27 carries cam 28 at its distal end and has cam 29, spaced back from the cam 28, defining a notch 52 therebetween. An aperture 53 through the plate 15 at the rearward edge of the cantilever portion 27 defines a pair of hinges 54 for the cantilever portion at its pivot axis, enhancing the ability of the cantilever portion to pivot about its pivot axis.

With reference to FIG. 7A, the cam 28 has a generally trapezoidal shaped cross-section with a forward or leading cam surface 55 and a trailing cam surface 56.

Prior to installing a detector head 12 on the detector base 11, the spring contact 26 can be moved manually to its operated position by flexing the tip of the free end 43 of the spring contact along the cam surface 29 (FIG. 6A) until it drops into the notch 52. The shorting spring then interconnects terminals 23 and 22, permitting checking of the wiring loop for the system.

For manual operation, prior to installing the detector head on the detector base, the shorting spring is actuated by the installer, the installer flexing the shorting spring until its free end drops into and is held in notch 52. The free end of the spring is biased rearwardly toward the position shown in FIG. 6, which defines the "at rest" position for the shorting spring. The positive locating of the shorting spring by virtue of its mounting and the trapezoidal shape of the cams assure that the cams will engage and flex the shorting spring, disengaging the spring during assembly of the detector head on the detector base.

Considering the actuating mechanism including cams 36 and 37 carried by the detector head 12, with reference to FIGS. 5 and 5A, the cam 36 on the detector head 12 has a leading cam surface 60, a trailing cam surface 61 and a bottom cam surface 62. The cam 36 is generally trapezoidal in shape.

Cam 36 cooperates with the cam 28 (FIGS. 7A,8A) depressing cam 28 to displace the cantilever portion 27 away from the head 12 as the cam 37 moves the shorting spring 26 from its rest position to its operated position. The cam 37 has a cam surface 64 which is moved to engage the rear surface 46*a* of the curved portion 46 of the shorting spring, as shown in FIG. 7, and moves therealong and onto the rear surface 43*a* of the free end of the spring contact (FIG. 8) deflecting the shorting spring forwardly during mounting of the detector head 12 on the detector base. During removal of the detector head from the detector base, cam 36 depresses cam 28 to displace cantilever portion 27 away from the head 12 as the free end of the shorting spring moves toward its rest position.

Referring to FIGS. 6, 7 and 8, in assembling the detector head 12 on the detector base 11, the activating mechanism including cam elements 36 and 37 on the detector head 12 and the activating mechanism including elements 27–29 on the detector base 11 cooperate to enable the cam 37 to move the shorting spring 26 against the force of its bias into engagement with the contact terminal 23 to interconnect terminals 23 and 22. Referring first to FIGS. 5, 6 and 6A, initially when the detector head 12 is aligned with the detector base 11, the cams 36 and 37 are located as shown in FIG. 6 relative to the shorting spring 26 and cam 28. In this position, the bevelled edge 64 on cam 37 affords clearance for the cam 37 relative to the stop post 47. The flat cam surface 62 on the bottom of cam 36 engages the upper top of the forward cam 28 such that as the detector head 12 is moved into the detector base 11, the cam 36 depresses cantilever portion 27. If the contact spring 26 has been actuated manually to its operated position with its free end 43 retained within the notch 52, then when the detector head 12 is installed on the detector base 11, cam 36 depresses the cantilever element 27, and frees the shorting spring 26, allowing it to restore under its resilience.

With rotation of the detector head 12 relative to the detector base 11, the cam 37 moves into engagement with the rear surface 46*a* of spring portion 46 as shown in FIG. 7 and the lower surface 62 of cam 36 rides across the cam 28 as shown in FIG. 7A. With continued rotation of the detector head 12 relative to the detector base 11 to its locking position, the slanting trailing edge surface 61 of cam 36 engages the trailing slanting surface 56 of cam 28, permitting free end of the cantilever portion to pivot upwardly. Cam 37 continues to move the free end 43 of the shorting spring forward until the shorting spring is moved to its operated position such that its contact portion 42 engages the contact 23, interconnecting the two terminals 22 and 23. Cam 37 maintains the spring contact in its operated position.

Upon removal of the detector head 12 from the detector base 11, the sequence of operations is similar but in the reverse. With reference to FIG. 8A, as the two elements are rotated counterclockwise relative to one another, the slanting cam surface 61 of cam 36 moves into engagement and rides along the slanting trailing cam surface 56 of cam 28, and the cantilever element 27 begins to be driven downwardly (FIG. 8A). With continued counterclockwise movement of the two elements relative to one another, cam 36 moves to the left in FIGS. 7 and 7A, with cam 36 riding over the top with its bottom edge 62 engaging the peak of cam 28. Also, as shown in FIG. 7, cam 37 has moved out of engagement with the free end of the spring contact and into engagement with its bend portion 46. With further relative counterclockwise movement of the detector head relative to the detector base, the free end of the spring contact moves backward under the force of its resilience until it engages the stop post 47.

Referring to FIGS. 9–12, which are labeled "PRIOR ART", in a known supervisory arrangement for a plug-in sensor unit, the circuit connection between the positive voltage input and the positive voltage output terminals is completed through connections in the detector head, and the switching action of the shorting spring opens a circuit rather than completing a circuit path as in the supervisory arrangement of the present invention.

Figure 10:
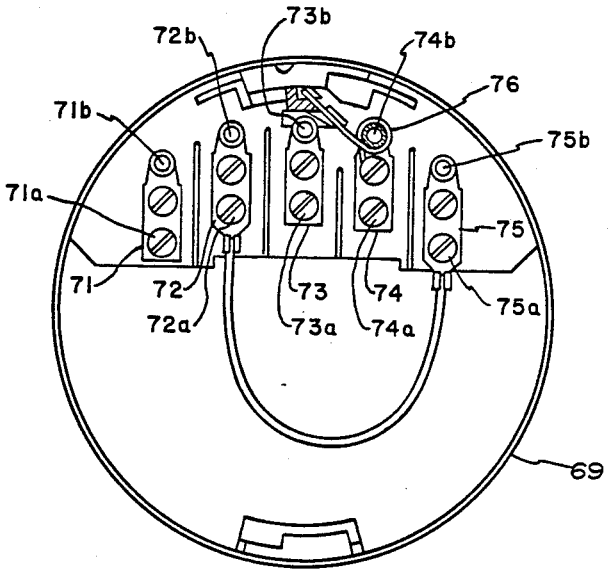
FIG. 10 PRIOR ART
FIG. 10, which is labeled "PRIOR ART", is a plan view of the lower surface of a detector base for a known plug-in sensor unit, illustrating the connection terminals thereof.
Figure 11:
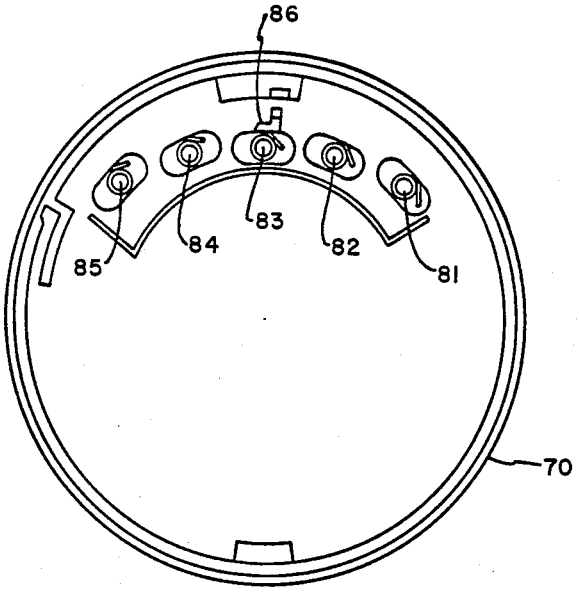
FIG. 11 PRIOR ART
FIG. 11, which is labeled "PRIOR ART", is a plan view of the upper surface of a detector head which mates with the detector base illustrated in FIG. 10.
Figure 12:
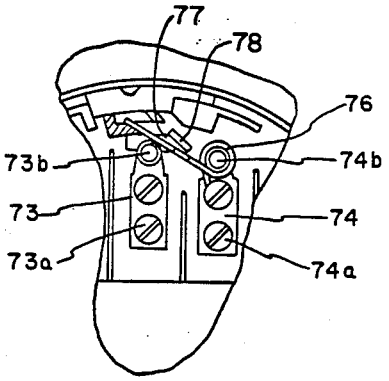
FIG. 12 PRIOR ART
FIG. 12, which is labeled "PRIOR ART", is an enlarged fragmentary view of the shorting spring of the detector base shown in the operated position.

More specifically, with reference to FIGS. 10–12, one known prior art plug-in sensor unit includes a base unit 69 and a detector head 70 adapted to be plugged into the detector head. The detector base 69 includes a plurality of terminal strips 71–75 having a positive voltage input screw terminal 73*a*, a positive voltage output screw terminal 74*a*, a negative voltage input screw terminal 72*a*, a negative voltage output screw terminal 75*a*, and an annunciator screw terminal 71*a*. Each terminal strip 71–75 further includes a contact post 71*b*–75*b* extending outward from the detector base. The negative voltage input and negative voltage output terminals are interconnected by a shorting loop 77.

Figure 9:
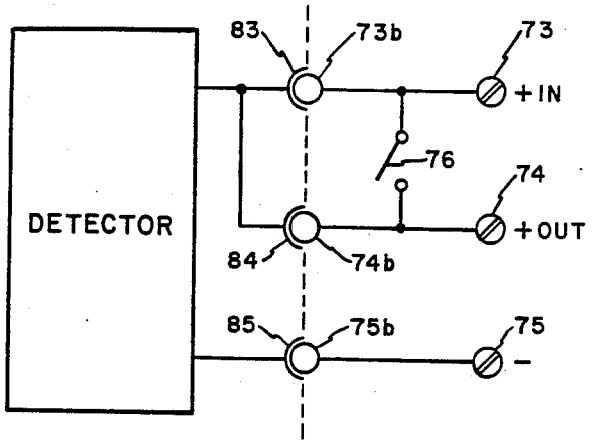
FIG. 9 PRIOR ART
FIG. 9, which is labeled "PRIOR ART", is an electrical wiring diagram of a prior art detector.

A shorting spring 76, in the form of a coil spring, normally interconnects terminals 73 and 74, completing a circuit between the positive input terminal 73 and the positive output terminal 74 as shown in FIG. 9. The shorting spring has one end wrapped around the base of contact post 74*b* and secured to terminal 74 by screw 74*c*. The free end of the shorting spring extends toward contact post 73*b* and is biased into engagement with contact post 73*b*, defining the at rest position for the shorting spring. The detector base has an inclined surface 77 which defines a vertical stop surface 78 which enables the shorting spring to be maintained out of contact with terminal 73.

The free end of the shorting spring can be moved manually from its at rest position away from contact post 73*b*, the inclined surface 77 guiding the end of the spring contact away from the head 12 to engage the stop surface 78 such that the spring contact is maintained in its operated position out of engagement with the contact post 73*b*.

The detector head 70, shown in FIG. 11, includes a plurality of connectors 81–85 which receive the contact posts 71*b*–75*b*, respectively, a cam 86 which is effective upon assembly of the two elements together and with relative rotation in a clockwise direction to engage the shorting spring 76 and move it out of engagement with the terminal 73. When the detector head is mounted on the detector base, contacts 83 and 84 of the detector head, which are interconnected, complete the circuit path provided by shorting spring 76 when manually operated to its shorting position.

Because the connections are made within the detector head, an additional contact 83 is required in contrast to the system of the present invention which only requires two terminals 24*b* and 22*b* as shown in FIG. 2. Also, the circuit between the positive voltage in and positive voltage out terminals is interrupted when a detector head is mounted on the detector base whereas in the plug-in sensor unit of the present invention, a circuit path between the negative voltage input and the negative voltage output circuit is completed through the shorting spring.

What is claimed is:

1. In a plug-in sensor unit including a detector base and a detector head constructed and arranged for removable mounting on the detector base and to be locked to the detector base with movement of the detector head relative to the detector base to a locking position, the detector head housing a detector having contacts engaging terminals on the detector base when the detector head is assembled together with the detector base and moved to its locking position, the improvement comprising contact means mounted on the detector base adjacent to first and second ones of the terminals, said contact means having a mounting portion connected to the first terminal and a contact portion movable between a first position where it engages the second terminal and a second position where it is disengaged from the second terminal, said contact means interconnecting the first and second terminals when its contact portion is at its first position, and actuating means on the detector head engaging said contact means during mounting of the detector head on the detector base to move said contact portion of said contact means from its second position to its first position, means for retaining said contact portion of said contact means at its first position, and release means operated by said actuating means during removal of the detector head from the detector base allowing said contact portion of said contact means to return to its second position.

2. A plug-in sensor unit according to claim 1, wherein said actuating means operates said release means whenever the detector head is mounted onto the detector base whereby said contact portion of said contact means is at its second-position prior to relative movement of the detector head and detector base to their locking position.

3. A plug-in sensor unit according to claim 1, wherein said release means includes a cantilever mounted element on the detector base and defining a first cam surface on the distal end of said cantilever mounted element, said cantilever mounted element defining retaining means for receiving said contact portion of said contact means and said actuating means includes means defining a second cam surface on the detector head and located to engage said first cam surface for depressing said cantilever mounted element, pivoting said cantilever mounted element away from the detector head, permitting said contact portion of said contact means to move under the force of its resilience when said cantilever mounted element is depressed.

4. A plug-in sensor unit according to claim 3, wherein said contact portion is movable manually to its first position to be retained by said retaining means, and wherein said actuating means defines a third cam surface on the detector head and located to engage said contact means and to release said contact portion of said contact means from said retaining means of said cantilever mounted element during assembly of the detector head on the detector base.

5. A plug-in sensor unit according to claim 4, wherein said retaining means comprises a notch formed on an upper surface of said cantilever mounted element.

6. A plug-in sensor unit according to claim 3, wherein said actuating means defines a third cam surface on the detector head and located to engage said contact means to move said contact portion to said first position during assembly of the detector head on the detector base and to maintain said contact portion at said first position as long as said detector head is at said locking position.

7. A plug-in sensor unit according to claim 1, wherein the interconnection between said first and second terminals is made solely by said contact means on said detector base.

8. A plug-in sensor unit according to claim 1, wherein said contact means comprises a spring contact having a fixed end secured to the detector base and a free end extending in cantilever fashion from said fixed end and defining said contact portion.

9. A plug-in sensor unit according to claim 8, wherein the detector base further comprises means for pre-loading said spring contact, biasing it toward a selected position.

10. A plug-in sensor unit including a detector base and a detector head constructed and arranged for removable mounting on the detector base and to be locked to the detector base with movement of the detector head relative to the detector base to a locking position, the detector head housing a detector having contacts engaging terminals on the detector base when the detector head is assembled together with the detector base and moved to its locking position, the improvement comprising a shorting spring mounted on the detector base adjacent to first and second ones of the terminals, the shorting spring having a mounting portion connected to said first terminal and a contact portion movable between a first position where it engages the second terminal and a second position where it is disengaged from the second terminal, the shorting spring electrically interconnecting the first and second terminals when its contact portion is at its first position, and actuating means including cam means on the detector head, and release means, said cam means having first means to move said contact portion of said shorting spring from its second position to its first position during mounting of the detector head on the detector base and to retain said contact portion of said shorting spring at its first position, said cam means having second means cooperating with said release means during removal of the detector head from the detector base allowing said contact portion of said shorting spring, allowing it to return to its second position.

11. A plug-in sensor unit according to claim 10, wherein said second means of said cam means is brought into engagement with said release means during relative movement of the detector head and the detector base to their locking position and operates said release means whenever the detector head is mounted onto the detector base to insure that said contact portion of said shorting spring is at its second position prior to relative movement of the detector head and detector base to their locking position.

12. A plug-in sensor unit according to claim 11, wherein the detector base further comprises means for pre-loading said shorting spring, biasing it toward a selected position.

13. A plug-in sensor unit according to claim 11, wherein said release means includes a cantilever mounted element on the detector base and means defining a cam surface at the distal end of said cantilever mounted element, said second means on the detector head located to engage said cam surface for depressing said cantilever mounted element, pivoting said cantilever mounted element away from the detector head, and said cantilever mounted element defining retaining means for retaining said contact portion of said shorting spring and for permitting said contact portion of said shorting spring to move under the force of its resilience when said cantilever mounted element is depressed.

14. A plug-in sensor unit according to claim 13, wherein said first means on the detector head includes a cam located to move said contact portion of said shorting spring to its first position during assembly of the detector head on the detector base and to maintain said contact portion thereat.

15. A plug-in sensor unit according to claim 13, wherein said retaining means comprises a notch formed on a selected surface of said cantilever mounted element.

16. In a plug-in sensor unit including a detector base and a detector head constructed and arranged for movable mounting on the detector base, the detector head having a detector with first and second contacts engaging terminals on the detector base when the detector head is assembled together with the detector base, the improvement comprising a shorting spring mounted on the detector base adjacent to first and second ones of the terminals, said shorting spring having a mounting portion connected to said first terminal and a contact portion movable between a first position where it engages the second terminal and a second position where it is disengaged from the second terminal, said shorting spring electrically interconnecting the first and second terminals when its contact portion is at its first position, and actuating means including first cam means on the detector head defining a first cam surface for engaging said contact portion during mounting of the detector head on the detector base to move said contact portion from its second position to its first position, and retaining means to retain said contact portion of said shorting spring at its first position, and release means cooperating with said first cam means during removal of the detector head from the detector base to allow said contact portion of said shorting spring to return to its second position.

17. A plug-in sensor unit according to claim 16, wherein said release means includes second cam means and support means cantilever mounted on the detector base with said second cam means carried on the distal end of the cantilever mounted support means, said support means defining said retaining means for receiving and retaining said contact portion of said shorting spring, said first cam means defining a second cam surface on the detector head located to engage said second cam means, for depressing said support means, pivoting said support means away from the detector head, permitting said contact portion of said shorting spring to move to its second position under the force of its resilience.

18. A plug-in sensor unit according to claim 16, wherein said first cam means defines a second cam surface on the detector head located to engage said support means for depressing and subsequently releasing said support means during assembly of the detector head on the detector base.

19. A plug-in sensor unit according to claim 16, wherein said first cam means maintains said contact portion of said contact spring at its first position when the detector head is assembled together with the detector base.

20. A plug-in sensor unit according to claim 17, wherein said contact portion is movable manually to said first position to be received by said retaining means prior to assembly of said detector head on said detector base.

21. A method of maintaining conductivity along a selected conductor where the conductor enters and exits a base member as a functional unit engages the base member, the method comprising the steps of:

providing a short circuit between the conductor entrance and exit;

engaging the functional unit with the base while sequentially interrupting the short circuit as the functional unit begins to engage the base member; and restoring the short circuit as the functional unit completes engagement with the base member.

22. A method as in claim 21 including:

removing the functional unit and interrupting the short circuit.

* * * * *

UNITED STATES PATENT AND TRADEMARK OFFICE

CERTIFICATE OF CORRECTION

PATENT NO. : 4,829,283

DATED : May 9, 1989

INVENTOR(S) : Spang et al.

It is certified that error appears in the above-identified patent and that said Letters Patent is hereby corrected as shown below:

On the first page thereof, at [75], the third inventor's name, "William H. MacPherson", should be --William A. MacPherson--.

Signed and Sealed this

Fifteenth Day of January, 1991

*Attest:*

HARRY F. MANBECK, JR.

*Attesting Officer*

*Commissioner of Patents and Trademarks*